US006745519B2

(12) United States Patent
Edger

(10) Patent No.: US 6,745,519 B2
(45) Date of Patent: Jun. 8, 2004

(54) GARDEN WINDOW HANGERS

(75) Inventor: Ronal Fredrick Edger, Bolton (CA)

(73) Assignee: Royal Group Technologies Limited, Woodbridge (CA)

( * ) Notice: Subject to any disclaimer, the term of this patent is extended or adjusted under 35 U.S.C. 154(b) by 61 days.

(21) Appl. No.: 09/916,260

(22) Filed: Jul. 30, 2001

(65) Prior Publication Data

US 2002/0014044 A1 Feb. 7, 2002

(30) Foreign Application Priority Data

Jul. 31, 2000 (CA) ..... 2314791

(51) Int. Cl.[7] ..... E06B 3/00

(52) U.S. Cl. ..... 52/27; 52/73; 52/201; 52/745.11; 52/745.16; 16/269; 49/381; 49/191; 47/40

(58) Field of Search ..... 52/27, 37, 73, 52/201, 204.5, 208, 745.11, 745.15, 745.16; 16/269; 49/381, 501, 188, 191; 47/40; 312/102

(56) References Cited

U.S. PATENT DOCUMENTS 974,953 A * 11/1910 Darlinton ..... 16/269
2,799,890 A * 7/1957 Stavich ..... 16/269
3,074,125 A * 1/1963 Miller ..... 52/201
3,319,378 A * 5/1967 Andrews et al. ..... 47/40
4,023,306 A * 5/1977 Ruggieri, Jr. ..... 47/40
4,038,791 A * 8/1977 Atkinson ..... 312/102
4,060,119 A * 11/1977 Nohmura et al. ..... 160/22
4,335,547 A * 6/1982 Maxwell ..... 47/17
4,462,183 A * 7/1984 Bruhm ..... 47/40
5,099,623 A * 3/1992 Smith et al. ..... 52/201
5,749,183 A * 5/1998 Wright ..... 248/323
5,862,642 A * 1/1999 Erwin ..... 52/736.3
6,017,019 A * 1/2000 Erwin ..... 256/65
6,167,897 B1 * 1/2001 Resso et al. ..... 135/121

FOREIGN PATENT DOCUMENTS

JP 406026279 A * 2/1994 ..... 52/201
JP 406158944 A * 6/1994 ..... E06B/3/00

* cited by examiner

*Primary Examiner*—Brian E. Glessner

(57) ABSTRACT

The installation of a garden window which encloses an opening in the wall of a building is effected by installing a support structure above the wall opening from which the garden window can be hung, then hanging the garden window from this structure in opening closing position and then permanently securing same to the wall. Also included in the invention are the garden window itself and its hanger support to facilitate such installation.

10 Claims, 4 Drawing Sheets

PRIOR ART

GARDEN WINDOW HANGERS

FIELD OF THE INVENTION

This invention relates to window additions commonly known as garden or greenhouse windows or mini-solariums which project out from a room thus expanding or adding an extra dimension to a room while bathing the room in sunlight.

More particularly, the invention relates to the installation of such garden or greenhouse windows or mini-solariums and their construction to facilitate such installation.

BACKGROUND OF THE INVENTION

The addition of a projecting window structure to expand a room and to provide a greenhouse environment in which exotic plants and flowers can be grown all year long are now experiencing widespread use. Such windows, known as garden or greenhouse windows or mini-solariums (hereinafter "garden windows"), are in the form of a relatively large and heavy box like structure open at one side to give access into the window from within the room it expands. From the open side, the window structure has an outwardly and downwardly sloping glass paneled top wall, a glass paneled outer wall, glass paneled side or end walls and a solid bottom or base. The top wall may also be hinged at the room side for ventilation.

In effect, these garden windows are cantilevered out into space from the outer wall of the room they expand being unsupported from beneath the base. As a result, the installation of such garden windows is very awkward requiring holding the window up in position while the installer secures at least the upper edge of the window to the building above the opening the window is to enclose. Thus several workmen are required in carrying out the installation.

The present invention provides a means of greatly simplifying and facilitating the installation of these garden windows.

SUMMARY OF THE INVENTION

Thus the invention resides in facilitating the installment of a garden window into position to close the opening in the wall of a building provided for the window. According to the invention in carrying out the installation a support structure or hanger is first installed above the window wall opening. This support structure or hanger is such that the window can be hung therefrom. Following the installation of the window hanger, the window is hung from the hanger in position to enclose the opening after which the window is permanently secured in position.

In a preferred embodiment of the invention, the support structure or hanger installed above the building opening is an elongated channel forming an upwardly facing hook on which the window can be hooked and suspended.

Again, according to a preferred embodiment of the invention, the inner upper edge of the window is provided with an elongated rail having a downwardly facing hook portion for hooking unto the upwardly facing channel hook installed above the opening in the building. Further, according to a preferred form of the invention, the rail is formed to provide a locating bearing surface below the hook portion to butt against the wall of the building immediately above the window opening.

Still further, according to a preferred form of the invention, the rail is a hollow plastic extrusion having a metal reinforcing insert.

Thus the invention also resides in the provision of a novel garden window which is adapted to be hung from a support above the wall opening to be enclosed by the window.

DETAILED DESCRIPTION ACCORDING TO THE PREFERRED EMBODIMENTS OF THE PRESENT INVENTION

Figure 1:
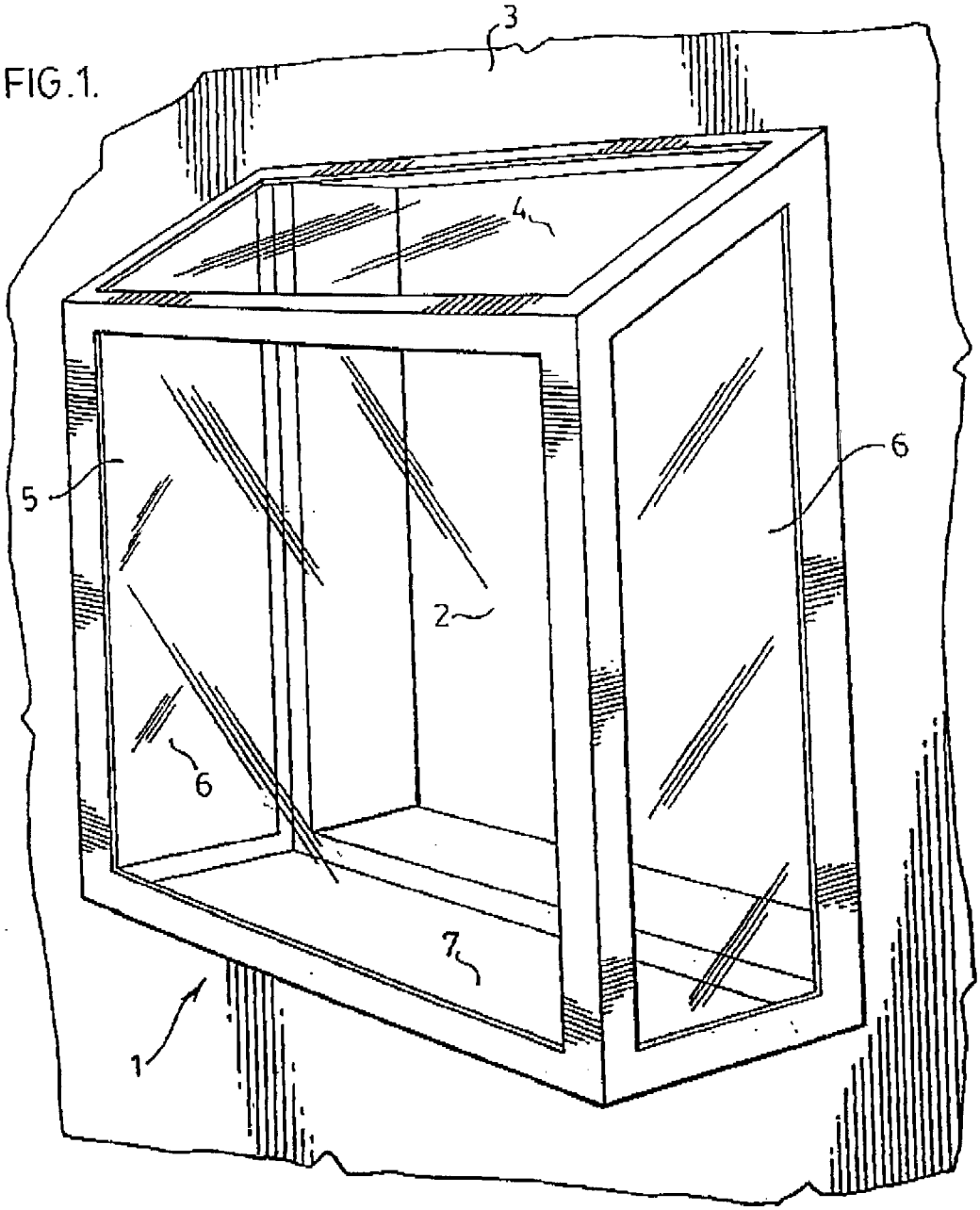
FIG. 1 is a perspective view illustrating how a garden window is cantilevered out from the building wall when mounted to enclose an opening in the wall provided therefor, the opening giving access to the garden window from the interior of the building.

With reference to FIG. 1, there is shown a typical prior art installation of a garden window generally designated at 1 which is in the form of a box like structure sized to encompass the opening 2 extending through the wall 3 of the building. As will be noted, the window 1 is cantilevered out from the wall of the building and is unsupported from beneath.

Typically, the window 1 has an outwardly and downwardly sloping upper light transmitting wall 4, a vertical front light transmitting wall 5, side or end light transmitting walls 6 and a base 7. The rear of the window opposite the front wall 5 will of course be open so that access to the interior of the window 1 can be obtained from within the room provided with the opening 2.

While the garden window 1 is shown as having single glass or light transmitting panels in the walls 4, 5 and 6 such walls in garden windows may be made of multiple light transmitting panels depending upon the size of the window.

As mentioned with the garden window 1 projecting outwardly from the wall 3 of the building as a cantilevered structure unsupported from beneath it depends for its support upon the securement of the rear of the window to the wall of the building around the opening 2, such securement being effected by screws or other fasteners.

In installing garden window such as the window 1, it will be appreciated that the weight of the windows which increases with size makes them very awkward to handle. They must somehow be held in position while an installer is securing the rear of the window to the wall of the building. For example, it may require a couple of workmen to support the window in proper position while an installer is securing the window to the wall of the building.

Figure 2:
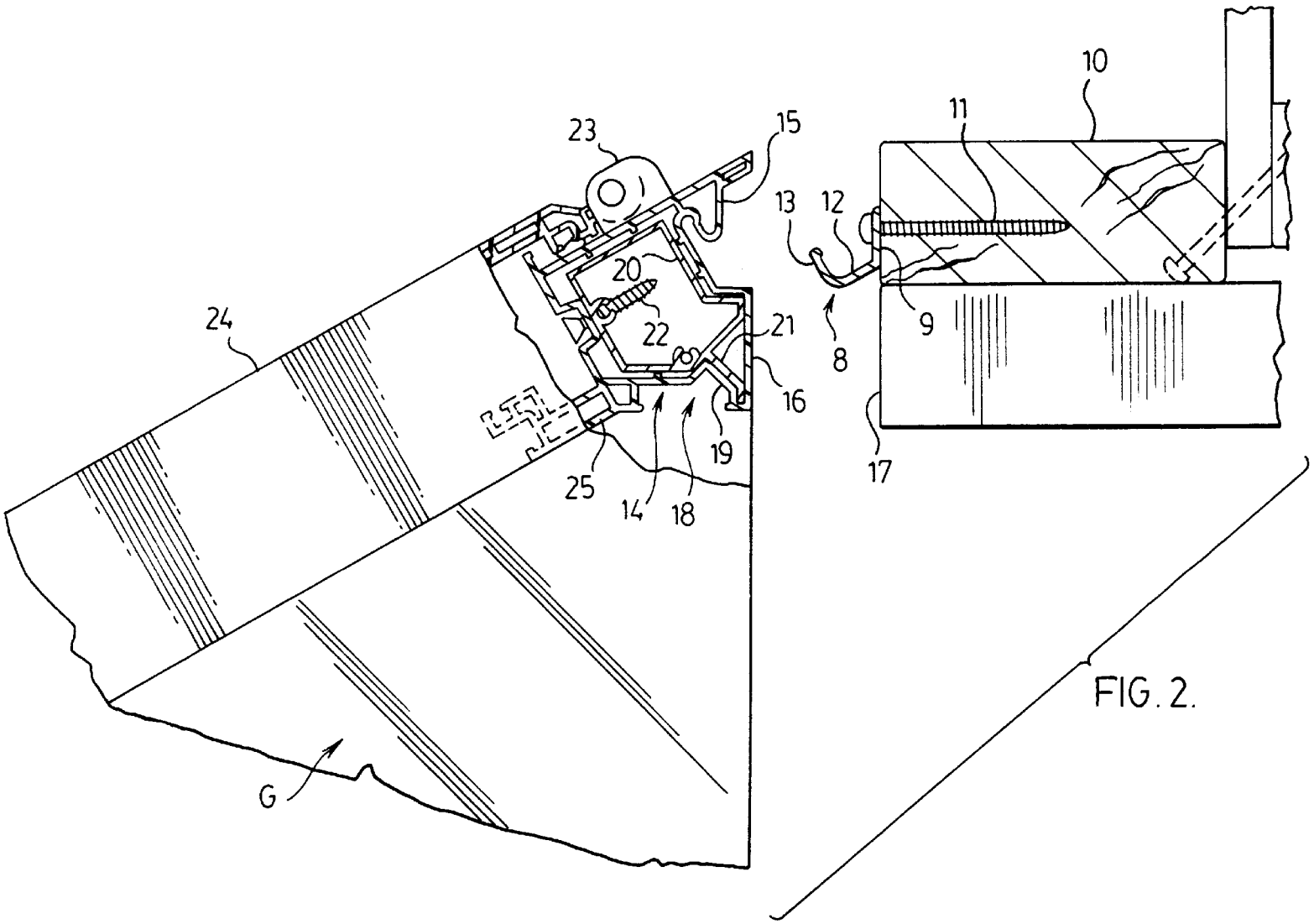
FIG. 2 is a broken away part vertical elevational part vertical sectional view illustrating a garden window adapted according to the invention to be hung according to the invention from a hanger secured to the wall of the building above the opening to be enclosed by the window.

FIG. 2 illustrates how the problems of supporting the garden window during mounting are overcome by hanging the window from a hanger installed above the wall opening which is to be enclosed by the window and illustrating preferred hanger and window interengaging means to enable the hanging of the window to be effected.

Figure 4:
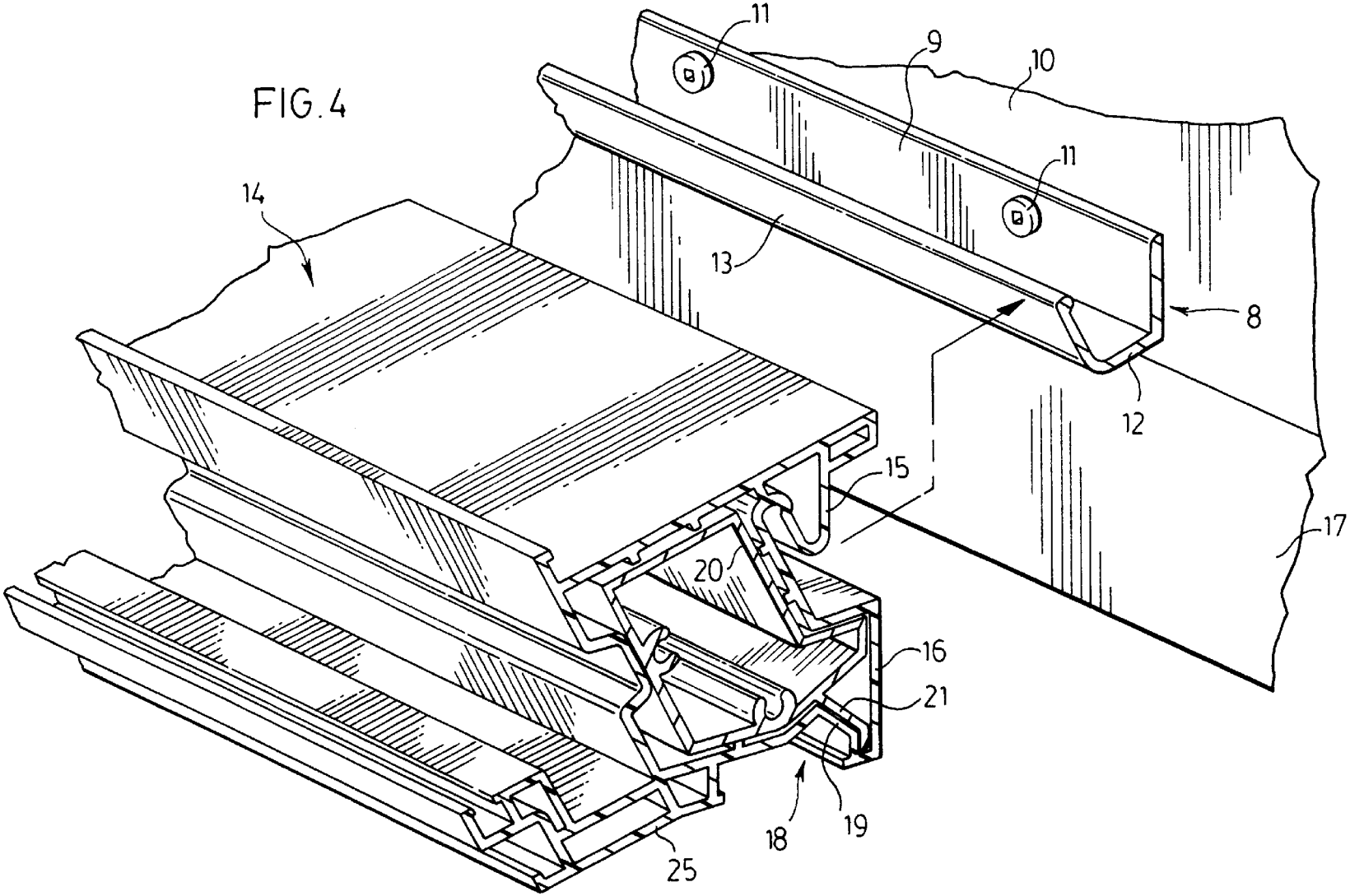
FIG. 4 is a broken away perspective view showing the wall hanger from which the garden window is to be suspended and illustrating the mounting rail which extends along the upper inner edge of the window for hooking onto the wall hanger to initially suspend the window in position while the installer makes the installation permanent.

As illustrated in FIG. 2, attached to the wall of the building is a hanger member 8 which, as best seen in FIG. 4, is in the form of an elongated hook like channel. The hanger channel 8 has a leg or wall 9 which is secured to a building wall member 10 by suitable screws 11. Connected to the leg 9 is a downwardly sloping bottom wall 12 and an upwardly and outwardly extending front hook wall 13.

The garden window illustrated in FIG. 2 and generally designated by the letter G is provided at its upper rear edge with a mounting rail generally designated at 14 in the form of a hollow extrusion having a hook portion 15 adapted to be hooked over the front hook wall 13 of the hanger member 8 secured to the building wall. Below the hook portion 15, the rail 14 has a planar bearing wall 16.

In this connection, it will be noted that the hanger member 8 is mounted sufficiently above the wall opening 1 and the wall of the building presents a bearing face 17 below the hanger member 8 against which the planar bearing wall 16 of the mounting rail 14 is adapted to bear.

The underside of the rail 14 is provided with a recess 18 having an angled forward wall 19 for a purpose which will hereinafter appear.

Sleeved within the rail 14 is a hollow metal reinforcing insert 20 which has a leg 21 providing a reinforcing backing behind the angled wall 19 of the recess 18.

The insert 20 is secured in position within the rail 14 by means of screws 22.

The mounting rail 14 is provided with hinge lugs 23 (only one being shown in FIG. 2) to which the top wall 24 of the window G may be hinged for ventilation.

Extending rearwardly from the rail 14 is a support leg 25 to support the top wall 24 of the window G from beneath.

Figure 3:
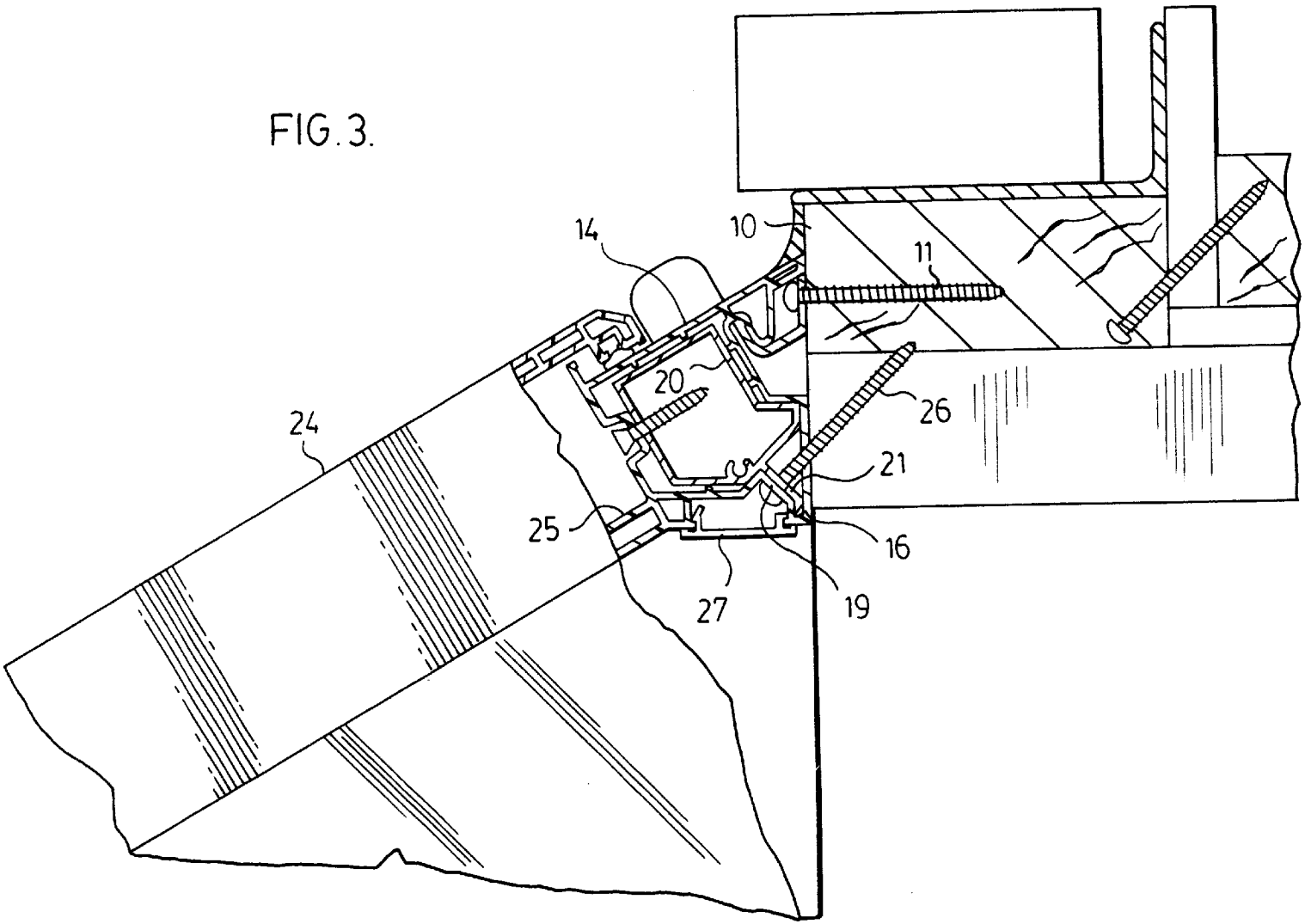
FIG. 3 is a broken away end elevational view showing the garden window in its supported position upon being hung from the wall hanger with the window permanently subsequently secured in position by screws driven into the building wall.

With reference to FIG. 3, it will be understood that once the hook portion 15 of the mounting rail 14 is hooked over the front hook wall 13 of the hanger member 8 and allowed to swing to bring the bearing surface 16 of the rail 14 into contact with the bearing face 17 of the wall the window G can be permanently secured in position by means of screws 26 driven through the angled wall 19 of the rail 14 and through the leg 21 of the insert 20 up into the building wall.

Following the permanent attachment of the window G, the recess 18 is closed by a snap lock cover 27.

It will be understood that in installing the window G the hanger member 8 is first installed sufficiently above the opening in the building to provide a width of wall sufficient to form the bearing face 17 therebeneath. The window G is then lifted and hung by means of the hook portion 15 of the mounting rail 14 allowing the hanger 8 to take the weight of the window with the window moving inwardly until the bearing wall 16 abuts the wall bearing face 17.

It will be understood that the base of the window G (not shown) will abut against the wall below the opening 1 when the bearing wall 16 abuts the bearing face 17 of the building wall.

Once the window is supported in position as shown in FIG. 3 the installer can then permanently secure it in that position by screws 26. It will be understood that the bottom of the window G can also be permanently screwed to the wall below the opening 1.

While a preferred embodiment of the invention has been illustrated, it will be understood that other forms of hangers may be attached to the wall of the building above the opening to be enclosed by the garden window in which case the garden window will be provided with appropriate means to suspend it from such a hanger to take the weight of the window while the installer is permanently securing same in position. These and other variations may be made without departing from the scope of the appended claims.

The embodiments of the invention in which an exclusive property or privilege is claimed are defined as follows:

1. A method of installing a garden window to enclose an opening in a wall of a building, said garden window having a box-like structure with light transmitting panels and an open rear side having an upper rear edge and a bottom wall, said method comprising the steps of installing on said wall spaced above said wall opening a support structure from which said window can be hung, then hanging said window by its said upper rear edge from said support structure to temporarily support said window while allowing said window to swing from said support structure to a position to engage said wall completely around said opening to entirely enclose said opening with said window cantilevered out from said wall and free of support from underneath whereby the weight of said cantilevered window presses same against said wall around said opening, then permanently securing the said window in fixed wall opening enclosing position.

2. A method as claimed in claim 1 in which the step of installing said support structure comprises the step of installing on said wall spaced above said wall opening an elongated upwardly facing channel shaped hook.

3. The method as claimed in claim 2 in which said garden window has a rail extending across its upper edge which said rail incorporates a downwardly facing hook formation, and said step of supporting said window from said support structure to provide for swinging of said window comprises hooking said downwardly facing rail hook formation on to said upwardly facing channel hook.

4. The method as claimed in claim 1, 2 or 3 in which said step of permanently securing said window in position comprises driving window securing screws into said building wall.

5. A method of installing a garden window, said garden window having a box-like structure with top, side and front light transmitting panels and an open rear side having an upper rear edge, said method comprising mounting a longitudinal upwardly facing hook member on a wall of a building spaced above an opening provided in said wall to be enclosed by said garden window, providing said garden window with a mating downwardly facing hook on its said rear upper edge, lifting said garden window and pushing same towards said wall until its said mating hook overlies said upwardly facing hook, then lowering said garden window to hook said garden window on to said hook mounted on said building wall and allowing said garden window to swing to bring said garden window into contact with said wall completely around said entire opening with said window cantilevered out from said wall free of support from underneath whereby the weight of said cantilevered window presses same against said wall around said opening, then permanently securing said garden window in fixed position to said wall.

6. A garden window to be hung from a hanger mounted on a wall of a building above an opening in the wall to be enclosed by said garden window, said garden window having a box like structure of a size to fully enclose the wall opening and having a light transmitting top wall sloping downwardly and forwardly from a rear edge, a light transmitting front wall, light transmitting side walls, and a planar base free of any depending support, said garden window being open at the rear and having a hanger rail extending along said rear edge of said top wall, said hanger rail having a downwardly opening hook portion for hooking on to said wall mounted hanger to temporarily assume the weight of said garden window while permitting swinging of said window against said wall to enclose the opening, said hanger rail having an abutment surface directly underneath said hook portion to bear against the building wall above the wall opening when said window encloses the wall opening whereby said window can be supported projecting out from said wall supported solely by said hanger rail and the wall pending permanent securement of the window to the wall.

7. A garden window as claimed in claim 6 in which said hanger rail comprises an extruded plastic sleeve having a metal insert therein.

8. A garden window as claimed in claim 7, in which said sleeve has an upwardly and rearwardly angled wall behind said abutment surface and said metal insert has an arm overlying said wall between said wall and said abutment surface.

9. A garden window as claimed in claim 8, in which said sleeve has an channel formation opening to the exterior and providing access to said angled wall and a cover for said channel.

10. A garden window as claimed in claim 7 or 8 in which said wall hanger is a channel having a mounting rear wall for securement to the wall of a building above the opening to be closed by said garden window and an upturned forward wall over which said hook portion of said garden window hanger rail is adapted to be hooked.

* * * * *